US009708868B2

(12) United States Patent
Vatne

(10) Patent No.: US 9,708,868 B2
(45) Date of Patent: Jul. 18, 2017

(54) SLIP DEVICE FOR SUSPENDING A DRILL OR CASING STRING

(71) Applicant: TTS Sense AS, Kristiansand (NO)

(72) Inventor: Per A. Vatne, Kristiansand (NO)

( * ) Notice: Subject to any disclaimer, the term of this patent is extended or adjusted under 35 U.S.C. 154(b) by 630 days.

(21) Appl. No.: 14/223,084

(22) Filed: Mar. 24, 2014

(65) Prior Publication Data

US 2014/0216817 A1 Aug. 7, 2014

Related U.S. Application Data

(63) Continuation of application No. 12/863,243, filed as application No. PCT/NO2009/000020 on Jan. 16, 2009, now Pat. No. 8,678,112.

(30) Foreign Application Priority Data

Jan. 17, 2008 (NO) ..... 20080307

(51) Int. Cl.
*E21B 19/10* (2006.01)

(52) U.S. Cl.
CPC ..... *E21B 19/10* (2013.01)

(58) Field of Classification Search
CPC ..... E21B 19/06; E21B 19/07; E21B 19/10
See application file for complete search history.

(56) References Cited

U.S. PATENT DOCUMENTS

| | | | |
|---|---|---|---|
| 1,445,445 | A | 2/1923 | Livergood |
| 1,501,962 | A | 7/1924 | Montgomery |
| 1,534,227 | A | 4/1925 | Livergood |
| 1,541,669 | A | 6/1925 | Summers |
| 2,134,468 | A | 10/1938 | Bashara |
| 3,052,943 | A | 9/1962 | Jones |
| 3,422,506 | A | 1/1969 | Turner |
| 3,538,561 | A | 11/1970 | Anastasiu et al. |
| 4,072,369 | A | 2/1978 | Segreto |
| 4,332,062 | A | 6/1982 | Byrne, Jr. |
| 6,089,338 | A | 7/2000 | Bouligny, Jr. |
| 8,678,112 | B2 | 3/2014 | Vatne |

FOREIGN PATENT DOCUMENTS

| | | |
|---|---|---|
| DE | 806426 | 2/1952 |
| GB | 899752 | 6/1962 |
| WO | 2007/126319 | 11/2007 |

OTHER PUBLICATIONS

Ban, PCT search report for PCT/NO2009/000020, Apr. 15, 2009.
Larsen, PCT International Preliminary Report on Patentability for PCT/NO2009/000020, Feb. 25, 2010.
Maukonen, Supplementary European search report and written opinion for EP 09702836, Sep. 20, 2012.

*Primary Examiner* — David Andrews
*Assistant Examiner* — Kristyn Hall
(74) *Attorney, Agent, or Firm* — Eubanks PLLC

(57) ABSTRACT

An apparatus for gripping a cylindrical member is provided. In one embodiment, an apparatus includes a clamping device having clamping dies that enable the clamping device to grip a tubular string. The clamping dies have clamping faces configured to adapt to curvature of the tubular string when the clamping dies engage the tubular string via the clamping faces to facilitate use of the clamping device with tubular strings of different external diameters. Additional devices, systems, and methods are also disclosed.

12 Claims, 7 Drawing Sheets

SLIP DEVICE FOR SUSPENDING A DRILL OR CASING STRING

BACKGROUND

This disclosure relates to a clamping device for temporarily suspending a drill or casing string from a drill floor. In at least some embodiments, a wedge device forms a substantially circular releasable attachment in an opening in the drill floor and is provided with a series of clamping dies having an engagement surface with variable curvature for engagement with the cylindrical tubular, and a spherical seat for support of the clamping device in the drill floor.

In drilling operations, e.g. exploration and production drilling for oil and gas, clamping devices are used in many situations to engage a cylindrical body, for example a pipe, in particular to suspend a drill pipe within circumscribing structures. One example of this is slips or slips means within a rotary table on a drill floor.

Since tubulars with different pipe diameters are used, a technique is used today where clamping dies, slips and other components that engage with the external pipe surface to retain the tubular in a firm grip, need to be replaced when changes in the external pipe diameter occurs. This is time consuming and costly, and it implies that several sets of clamping devices need to be available at a location that often suffers from lack of space.

When the drilling operations take place from a floating installation, e.g. a floating drill rig or a drill ship, the installation will be moved due to waves and currents in the body of water, and these motions can by a rigid connection between the clamping device and the drill floor result in that the drill string is subjected to bending loads from the clamping device.

SUMMARY

The disclosure relates in one aspect to a slips means having one or more clamping dies arranged for engagement with a cylindrical body, in which each clamping die includes a clamping face with a curved form where each lateral portion of the clamping face forms a lip having preferably tapering thickness, wherein within each of the adjacent lateral surfaces are formed a groove provided in parallel with the clamping face and extend inwardly towards a central plane through the clamping die. The grooves are filled with a flexible material, e.g. polyurethane, which provides for that the rigidity of the lips increases. When the clamping face is forced against a cylindrical body having larger radius than the radius of curvature of the clamping face, the lips are forced outwardly such that the engagement surface between the cylindrical body and the clamping face increases. Thus adequate clamping force is achieved without the spot load on the cylindrical body gets unnecessarily heavy. The flexibility of the lips is determined by their thickness, the material composition and type of material that is used in the grooves.

In a second aspect the disclosure relates to a spherical seat arrangement for the wedge device, where the wedge device is a slips means arranged within a rotary table associated with a drill floor.

In a third aspect the disclosure relates to a slips means which comprises a plurality of auxiliary wedges, each being arranged for slidable support of a clamping die, and where at least one of the auxiliary wedges is provided with an actuator which is arranged for displacement of the auxiliary wedge along an inclined plane.

As described below, one embodiment includes an arrangement in a clamping die for engagement with a cylindrical body, where the clamping die includes a clamping face that is arranged to be able to extend in parallel with the centre axis of the cylindrical body, wherein a groove is provided in each of two side surfaces adjacent to the clamping face and in close proximity to the clamping face, said groove extending substantially in parallel with the clamping face. The clamping face is preferably curved having a centre axis in parallel with the centre axis of the cylindrical body. Each of the grooves and the clamping face forms preferably a lip having substantially gradually tapering thickness from the bottom to the opening of the groove. The groove is preferably filled with a flexible material different from the material of the surrounding clamping die portions of the groove. The groove is preferably filled with polyurethane. The clamping die is preferably arranged in a slips means, a support tong, a power tong or a back-up tong. The slips means is preferably provided in a spherical seat within a rotary table of a drill floor. The spherical turning surface centre of the seat is preferably arranged within or in close proximity to the rotary axis of the rotary table. The slips means preferably comprises a plurality of auxiliary wedges, each being arranged for sliding support of a clamping die. Preferably at least one of the auxiliary wedges is provided with an actuator which is arranged for displacement of the auxiliary wedge along an inclined plane. Each of the auxiliary wedges is preferably connected to the adjacent auxiliary wedges by means of one or more carriers for synchronous motion of the auxiliary wedges.

BRIEF DESCRIPTION OF THE DRAWINGS

In the following an example of a preferred embodiment, which is illustrated in the appended drawings, will be described, where.

DETAILED DESCRIPTION OF SPECIFIC EMBODIMENTS

Figure 1:
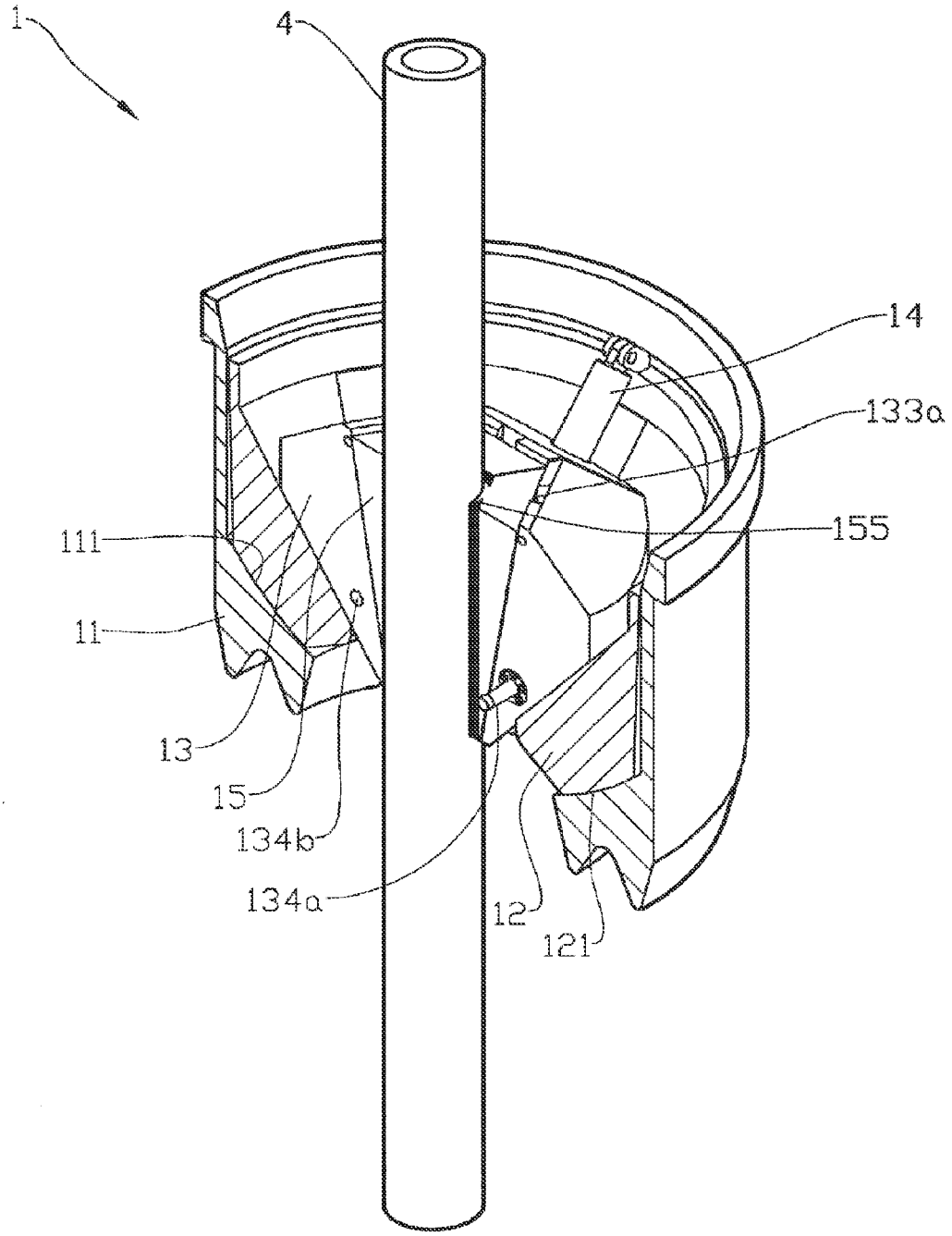
FIG. 1 shows a perspective cross section through a rotary table that comprises a slips means according to one embodiment.
Figure 2:
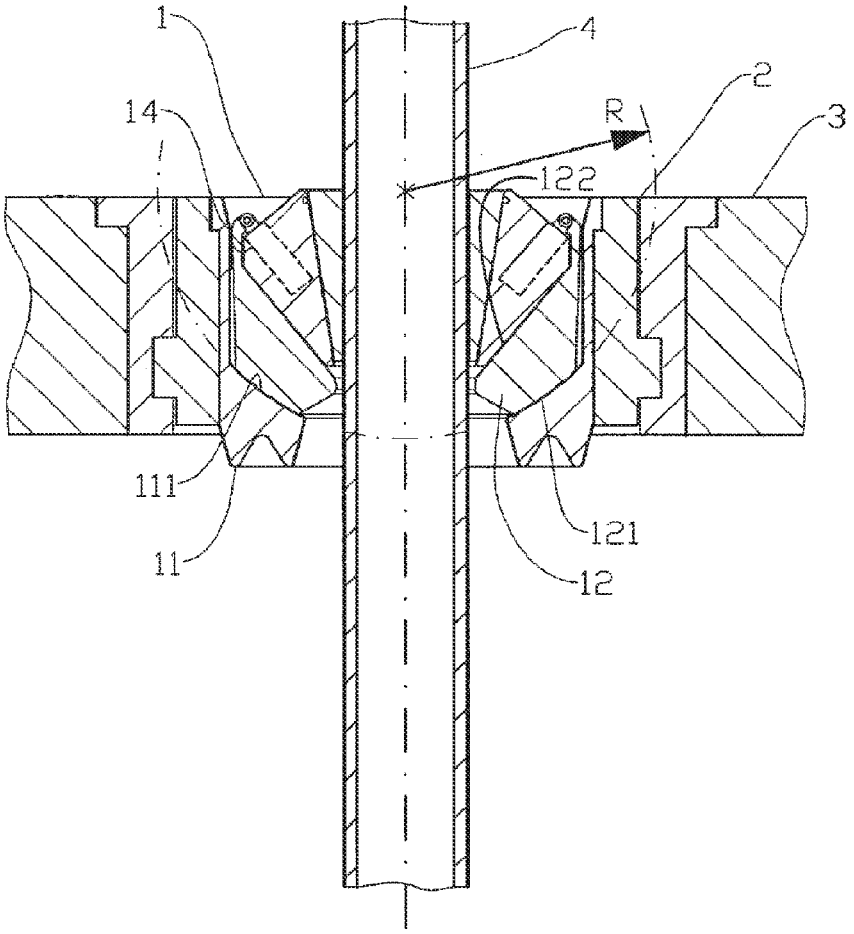
FIG. 2 shows a section through a rotary table having the slips means according to one embodiment.
Figure 3A:
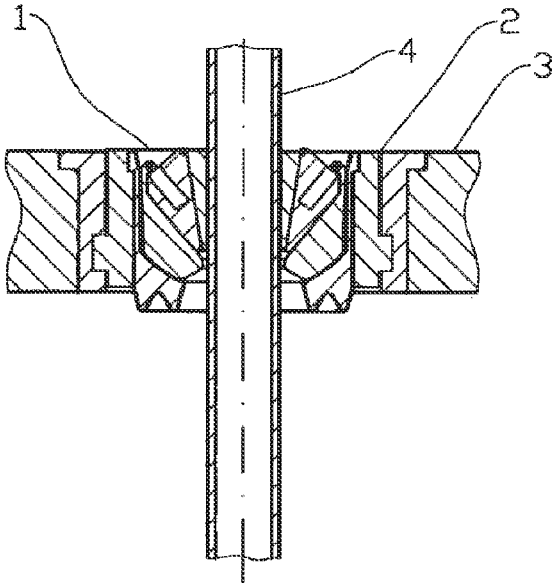
FIG. 3*a* shows in a smaller scale a corresponding section as in FIG. 2, where a centre axis of the pipe string is coincident with the rotary axis of the rotary table.
Figure 3B:
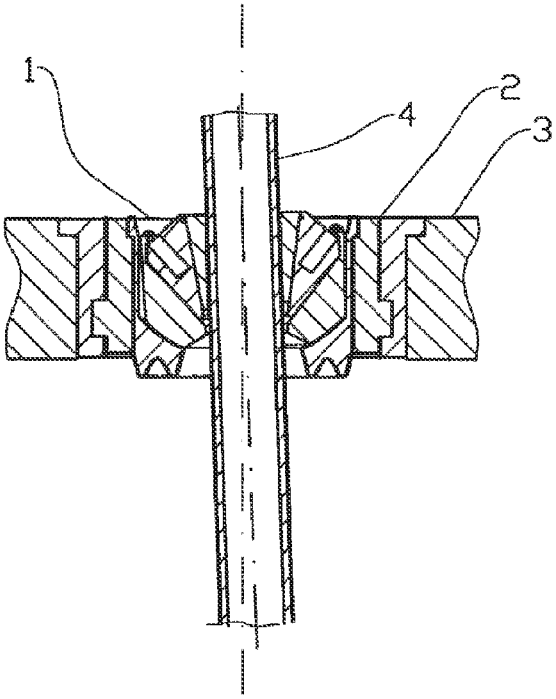
FIGS. 3*b* and 3*c* shows the pipe string suspended inclined in respect of the rotary axis of the rotary table.
Figure 3C:
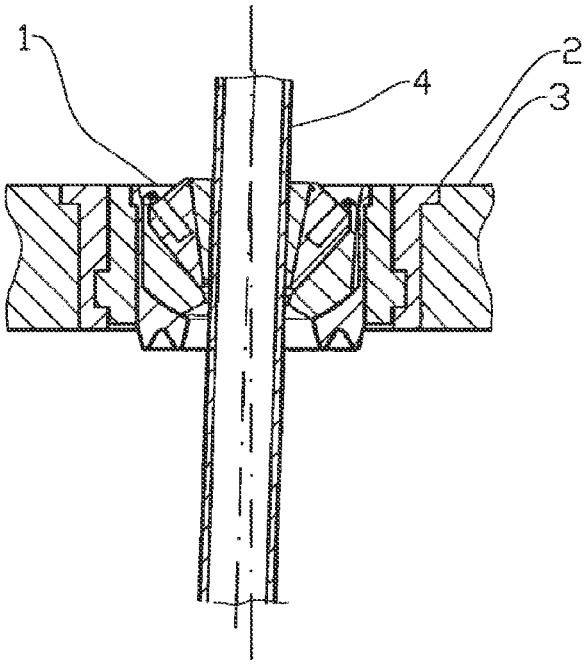
Figure 3D:
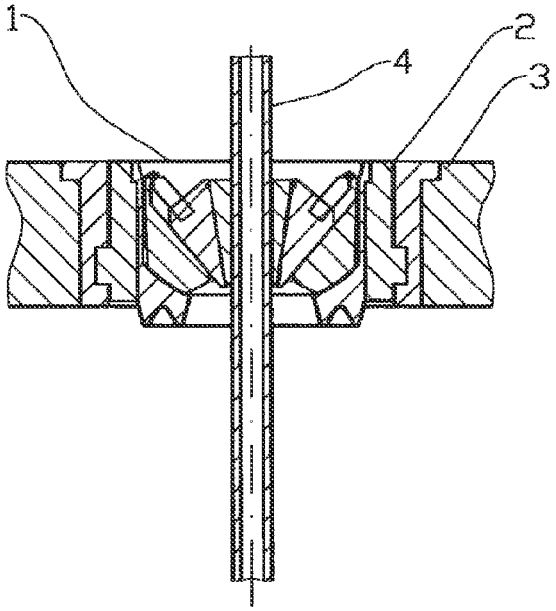
FIG. 3*d* shows the same situation as in FIG. 3*a*, but with the pipe string having smaller diameter.
Figure 4B:
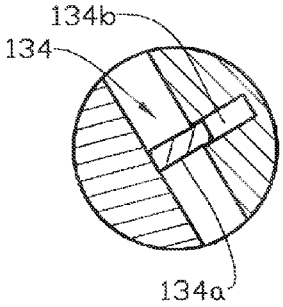
FIG. 4*b* is a detail view of a carrier connecting adjacent wedges in FIG. 4*a;*
Figure 4A:
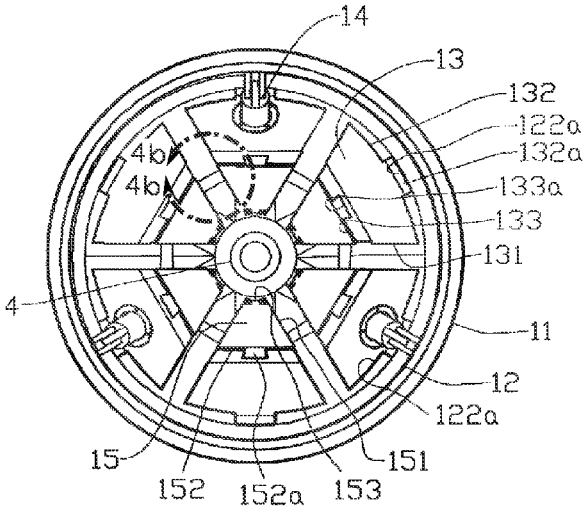
FIG. 4*a* shows in larger scale a top view of the rotary table having a pipe string freely movable in the slips means, the wedges being retracted.
Figure 4D:
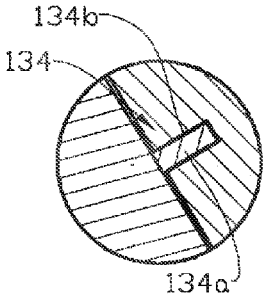
FIG. 4*d* is a detail view of the carrier shown in FIG. 4*c* with the wedges engaged against the pipe wall.
Figure 4C:
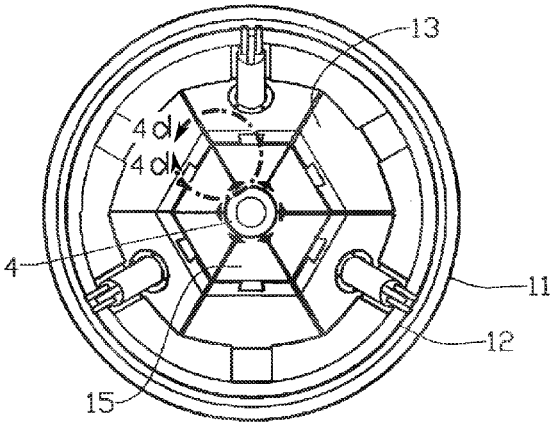
FIG. 4*c* shows a top view of the rotary table having a pipe string suspended in the slips means, said wedges being engaged against the pipe wall.
Figure 5A:
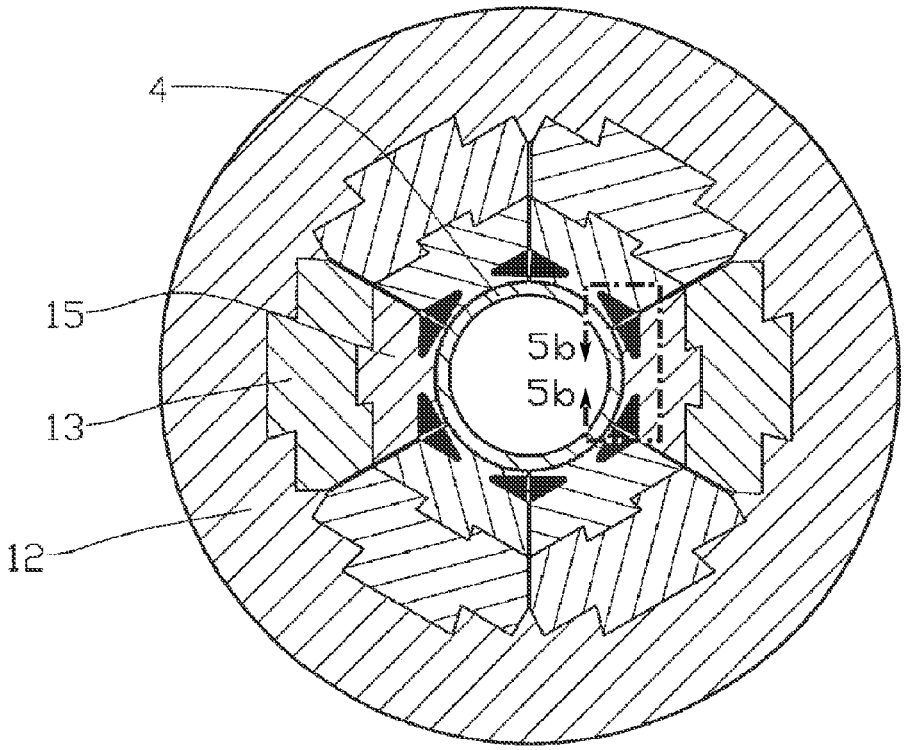
FIG. 5*a* shows in larger scale a cross section through the slips means when it grips around a pipe having small diameter.
Figure 5B:
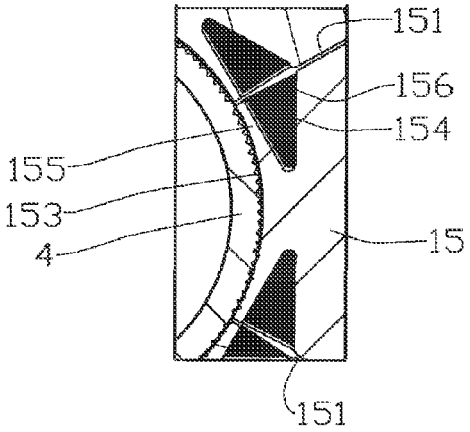
FIG. 5*b* is a detail view of longitudinal grooves in lateral surfaces of wedges depicted in FIG. 5*a;*
Figure 5C:
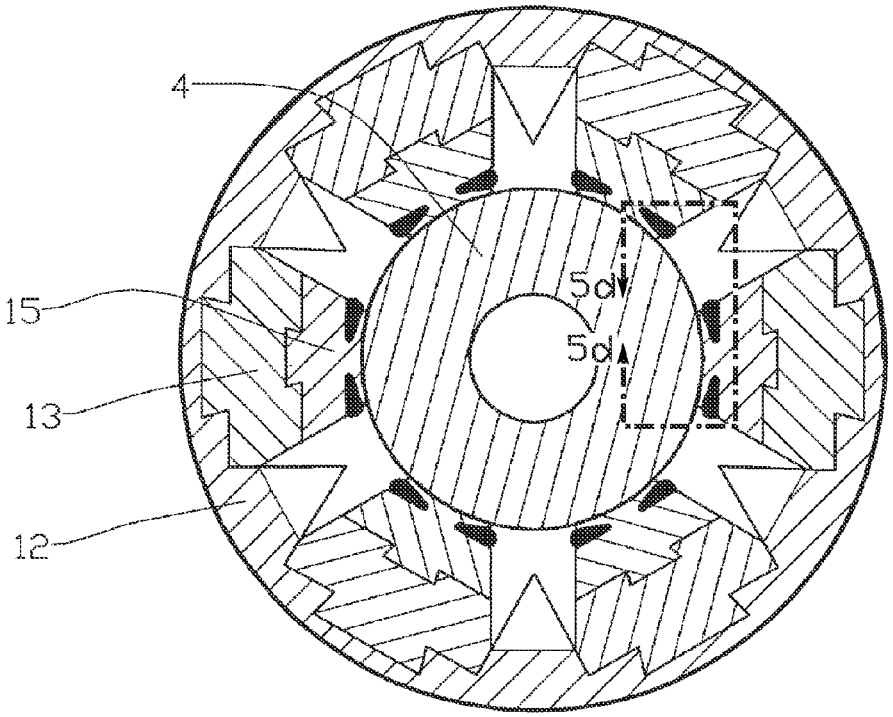
FIG. 5*c* shows what corresponds to FIG. 5*a*, but where a pipe having larger diameter is retained by the slips means.
Figure 5D:
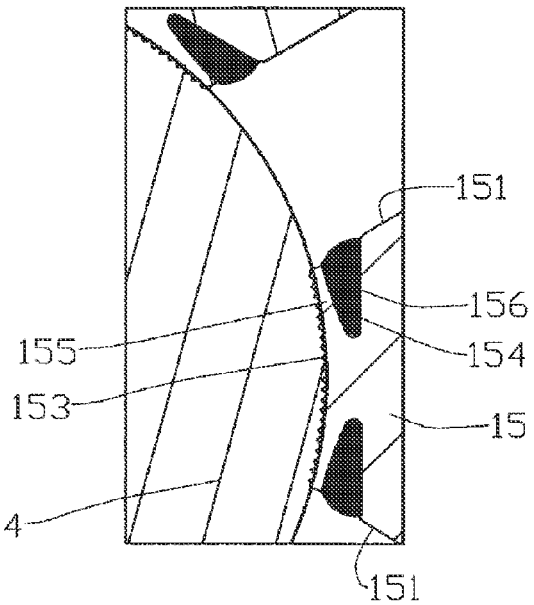
FIG. 5*d* is a detail view of a portion of FIG. 5*c* and generally shows flexing of lips formed by the longitudinal grooves in the lateral surfaces of the wedges when the wedges engage the larger-diameter pipe.

A slips means 1 is in a per se known way arranged in a per se known rotary table 2 in a drill floor 3, e.g. on a drill rig that is used during exploration and production drilling for oil and gas. The slips means 1 is arranged to releasably retain a cylindrical body 4, e.g. a drill pipe or a casing.

The slips means 1 is provided with an annular base sleeve 11 that is secured to the rotary table 2. The base sleeve 11 is provided with a spherical seat face 111 having radius R and with its centre located in the centre axis of the rotary table and in close proximity to the upper level of the rotary table 2.

A carrying sleeve 12 is arranged internally of the base sleeve 11, and a spherical support surface 121 is complementary to the seat face 111 of the base sleeve 11. The carrying sleeve 12 has an outer diameter that is slightly smaller than the internal diameter of the base sleeve 11, so that the carrying sleeve 12 thereby can be turned about the centre for the spherical seat face 111 with the consequence that the centre axis of the carrying sleeve 12 is not coincident with the centre axis of the base sleeve 11 and the rotary table 2.

The carrying sleeve 12 is internally provided with a total of six inclined first sliding surfaces 122 having centralized first dove tail grooves 122*a*. The sliding surfaces 122 are in the position of use of the slips means 1 inclined from top to bottom in the direction inwardly toward the centre axis of the carrying sleeve and with a centre line that is coincident with the first centre line of the dove tail groove 122*a* and is placed in a plane coincident with said centre axis.

Each sliding surface is arranged for receipt of an auxiliary wedge 13 having lateral surfaces 131 and a first bottom surface 132 and a top surface 133 which converge in the direction downwards and towards the centre axis of the carrying sleeve 12. The lateral surfaces 131 converge towards the top surface 133. The first bottom surface 132 is provided with an elongated first dove tail 132*a* complementary to the first dove tail groove 122*a*.

Every second auxiliary wedge is connected to the base sleeve 11 by means of an actuator 14, here shown as a hydraulic cylinder. Each auxiliary wedge 13 is connected to their adjacent auxiliary wedges 13 by a carrier 134 in the form of a pin 134*a* that projects from a lateral surface 131 of the auxiliary wedge 13 and engages slidable into a complementary recess 134*b* in opposing lateral surface 131 of the adjacent auxiliary wedge 13. Thus a direct displacement of an auxiliary wedge 13 along the sliding surface 122, by operating the actuator 14, results in that the adjacent auxiliary wedges 13 that are not directly connected with an actuator 14, move synchronous with the actuator 14. The operation of all the actuators 14 takes place simultaneously and at the same speed, and thus all the auxiliary wedges 13 move synchronous.

In the top surface 133 of the auxiliary wedge 13 a second dove tail groove 133*a* having a centre line is provided, which is located in a plane coincident with the centre axis of the carrying sleeve 12.

A wedge shaped clamping die 15 is provided with two lateral surfaces 151 and a second bottom surface 152 and an opposing clamping face 153 which together converge in the direction downwardly and towards the centre axis of the carrying sleeve 12. The lateral surfaces 151 converge towards the clamping face 153. The second bottom surface 152 is provided with an elongated second dove tail 152*a* complementary to the second dove tail groove 133*a* in the top surface 133 of the auxiliary wedge 13.

The clamping face 153 of the clamping die 15 is concavely curved having axis direction coincident with the centre axis direction of the carrying sleeve 12. In each of the two lateral surfaces 151 and in close proximity to the clamping face 153, a groove 154 is provided that extends substantially in parallel with the clamping face 153 in the entire longitudinal extension of the clamping die 15. Each of the grooves 154 and the clamping face 153 thus defines a lip 155. The width of the groove 154 is decreasing towards the bottom of the groove.

Each of the grooves 154 is filled with a flexible material 156, typically polyurethane, having elasticity considerably different from the material of the clamping die parts surrounding the grooves 154.

When the slips means 1 is inactive, the auxiliary wedges 13 are retracted, i.e. all the way up into the carrying sleeve 12 and within the central opening of the rotary table 2 a cylindrical body 4, e.g. a drill pipe, can freely be installed or displaced. When the drill pipe 4 is to be retained, the auxiliary wedges 13 are displaced by means of the actuators 14 downwardly and inwardly until the clamping face 153 of the clamping dies 15 engage the drill pipe 4. By the sliding motion of the clamping die 15 against the inclined top surface 133 of the auxiliary wedge 13, a pipe that is suspended in the rotary table 2 will pull the clamping dies downwardly, such that the grip or engagement with the drill pipe 4 is enhanced.

The spherical seat face 111 in the base sleeve 11 and the corresponding support surface 121 that the carrying sleeve 12 abuts the base sleeve 11 with, results in that the centre axis of the slips means and thus the centre axis of the retained cylindrical body 4 can adopt a direction that deviate from the centre axis of the rotary table 2 without adding a bending load to the body 4, for example when a drilling vessel is rolling due to waves.

The lips 155 of the clamping dies that define the clamping face 153 in axial direction form flexible lateral portions in the clamping faces. When the clamping die abuts a cylindrically designed body 4 having larger diameter than the diameter of curvature of the clamping face 153, the lips 155 will yield or give away, and the engaging surface between the clamping die 15 and the cylindrically formed body 4 increases and results in less surface pressure and thus less risk for deformation of the body 4 than if clamping dies according to the prior art that have less diameter of curvature than the diameter of the body 4 is used.

The flexible material 156 provides for that the rigidity of the lips 155 increases. Thus the depth of the grooves 154 can be increased, and the lip 155 can be made larger in order to further improve the properties of the clamping faces 153.

The invention claimed is:

1. An apparatus comprising:

a clamping device including clamping dies that enable the clamping device to grip a tubular string, wherein the clamping dies have clamping faces configured to adapt to curvature of the tubular string when the clamping dies engage the tubular string via the clamping faces to facilitate use of the clamping device with tubular strings of different external diameters, at least one clamping face includes a lateral edge for engaging the tubular string, and the lateral edge includes a clamping die lip configured to yield to the tubular string upon the at least one clamping face engaging the tubular string when the radius of curvature of the tubular string is greater than a radius of curvature of the at least one clamping face.

2. The apparatus of claim 1, wherein the clamping device includes auxiliary wedges connected to the clamping dies in a manner that allows the clamping dies to slide along the auxiliary wedges when the clamping device is moved into engagement with the tubular string.

3. The apparatus of claim 1, wherein the clamping dies have engagement surfaces of the clamping faces that can vary in curvature to complement the curvature of the tubular string.

4. The apparatus of claim 1, comprising a spherical seat in which the clamping dies are positioned.

5. The apparatus of claim 4, wherein the spherical seat is provided in a rotary table in a drill floor.

6. The apparatus of claim 1, comprising the tubular string.

7. The apparatus of claim 6, wherein the tubular string is at least one of a casing string or a drill string.

8. A method comprising:

receiving a pipe in a clamping device; and closing adaptable slips of the clamping device to retain the pipe in the clamping device, wherein closing the adaptable slips of the clamping device to retain the pipe in the clamping device includes moving engagement surfaces of the slips into contact with the pipe and adapting the curvature of the engagement surfaces of the slips in response to the contact with the pipe, at least one of the slips includes a lateral edge having a lip, and adapting the curvature of the engagement surfaces of the slips in response to the contact with the pipe includes the lip yielding to the pipe when the slips of the clamping device are closed to retain the pipe in the clamping device.

9. The method of claim 8, wherein adapting the curvature of the engagement surfaces of the slips in response to the contact with the pipe includes the pipe forcing opposing clamping face edges of each adaptable slip outwardly from each other.

10. The method of claim 8, comprising:

opening the adaptable slips to release the pipe and allow its removal from the clamping device;

after the pipe is removed from the clamping device, receiving an additional pipe in the clamping device, the additional pipe having a different external diameter than the pipe; and closing the adaptable slips of the clamping device to retain the additional pipe in the clamping device.

11. The method of claim 8, wherein adapting the curvature of the engagement surfaces of the slips includes moving edges of clamping faces of the slips to conform to the exterior of the pipe.

12. The method of claim 8, wherein closing the adaptable slips includes controlling the position of the adaptable slips with a hydraulic cylinder.

* * * * *